US005474364A

United States Patent [19]

Ruzzi et al.

[11] Patent Number: 5,474,364

[45] Date of Patent: Dec. 12, 1995

[54] SHOTGUN CARTRIDGE ROCK BREAKER

[75] Inventors: Peter L. Ruzzi, Eagan, N.M.; Roger J. Morrell, Bloomington, Minn.

[73] Assignee: The United States of America as represented by the Secretary of the Interior, Washington, D.C.

[21] Appl. No.: 326,300

[22] Filed: Oct. 20, 1994

[51] Int. Cl.[6] ..... E21C 37/14; F42D 1/22; F42D 3/04

[52] U.S. Cl. ..... 299/13; 102/319; 299/16

[58] Field of Search ..... 299/13, 16; 102/319, 102/322, 333

[56] References Cited

U.S. PATENT DOCUMENTS

| | | | |
|---|---|---|---|
| 921,144 | 5/1909 | McGregor | 102/333 |
| 1,571,122 | 1/1926 | Hutton | 102/322 |
| 2,866,508 | 12/1958 | Church | 166/55 |
| 3,960,082 | 6/1976 | Sloevsky et al. | 102/325 |
| 4,185,702 | 1/1980 | Bullard | 175/4.54 |
| 4,470,352 | 9/1984 | Leperre | 102/333 |
| 4,492,165 | 1/1985 | Marz | 102/313 |
| 4,572,075 | 2/1986 | Day | 102/313 |
| 4,900,092 | 2/1990 | Westhuizen | 299/13 |
| 5,308,149 | 5/1994 | Watson | 299/13 |

FOREIGN PATENT DOCUMENTS

| | | | |
|---|---|---|---|
| 827771 | 5/1981 | U.S.S.R. | 299/13 |
| 981604 | 12/1982 | U.S.S.R. | 299/13 |

*Primary Examiner*—David J. Bagnell
*Attorney, Agent, or Firm*—E. Philip Koltos

[57] ABSTRACT

A rock breaker uses shotgun cartridges or other firearm ammunition as the explosive charge at the bottom of a drilled borehole. The breaker includes a heavy steel rod or bar, a gun with a firing chamber for the ammunition which screws onto the rod, a long firing pin running through a central passage in the rod, and a firing trigger mechanism at the external end of the bar which strikes the firing pin to fire the cartridge within the borehole. A tubular sleeve surround the main body of the rod and includes slits the end to allow it to expand. The rod has a conical taper at the internal end against which the end of the sleeve expands when the sleeve is forced along the rod toward the taper by a nut threaded onto the external end of the rod. As the sleeve end expands, it pushes against the borehole and holds the explosive gasses within, and also prevents the breaker from flying out of the borehole. The trigger mechanism includes a hammer with a slot and a hole for accepting a drawbar or drawpin which, when pulled by a long cord, allows the cartridge to be fired from a remote location.

20 Claims, 2 Drawing Sheets

100
110
200
230
300
320
322
330
331
340
400
420
430
440
442
450
470
472
480
482
490
C

SHOTGUN CARTRIDGE ROCK BREAKER

FIELD OF THE INVENTION

The present invention relates to explosive devices for fracturing rock or other brittle material, where the material is drilled prior to fracturing.

BACKGROUND OF THE INVENTION

Rock, dense earth, concrete, and similar materials may be broken or cracked with explosive force inside a borehole drilled into the material. One simple method of rock breaking with explosives is to make a hole, insert an explosive charge, and detonate it. Since the hole is not closed, gas escapes from the hole and the pressure drops unless high explosive is used. If low explosives are used, other methods are helpful.

Watson et al., in U.S. Pat. No. 5,308,149, discuss two prior art methods: the "gas injector method" in which a pipe is inserted into a borehole, sealed against the rock near the bottom, and then a charge is fired in from outside; and the "hole bottom pressurization" method, in which a charge is exploded at the bottom of a borehole while a massive bar is in the borehole. The bar largely plugs the hole and prevents most gas leakage. The Watson device uses a high-inertia stemming bar 3, a shaped-charge cartridge 5, and firing means 2. Watson mentions various bar sealing techniques at col. 3, line 40.

U.S. Pat. No. 4,900,092 to Van Der Westhuizen et al discloses a rock-breaking gun in which a cartridge is fired in the external end of a heavy barrel inserted into a borehole. The barrel is tapered to seal against the lip of the borehole. The barrel screws onto a firing chamber 4 to seal the charge. A mat is used to restrain the recoil. The borehole is filled with water.

U.S. Pat. No. 4,572,075 to Day et al shows blasting in water in a borehole.

Church, in U.S. Pat. No. 2,866,508 discloses firing explosive charges 20 in a borehole in conjunction with resilient seals 12 and 26. A firing pin and percussion cap 22 are used.

U.S. Pat. No. 4,185,702, issued to Bullard, shows a drilling apparatus using a muzzle-loading gun with black powder charge to propel a bullet into the earth.

Leperre in U.S. Pat. No. 4,470,352 and Marz in U.S. Pat. No. 4,492,165 disclose specialized explosive cartridges.

The device of Sloevsky et al, disclosed in U.S. Pat. No. 3,960,082, is an explosive powered rock breaker. A pipe inserted into a borehole carries an explosive charge at the external end and a cap with openings on the internal end. The interior of the pipe is filled with water, which carries the explosive force from the charge to the cap, whence it issues through radial passages 11.

Hutton, U.S. Pat. No. 1,571,122, shows an explosive cartridge fired by a primer struck by a long firing pin 20 that extends through a rod. The firing pin is held from the primer by a spring, and fires the primer when released from being pulled back against a second spring. The firing pin includes an eye 25 for pulling and releasing it. Hutton does not disclose a hammer for hitting the firing pin.

The prior art does not disclose the use a cartridge (combined explosive and primer) in a firing chamber at the internal end of a rod or bar inserted into a borehole. Neither does the prior art disclose any use of conventional firearm ammunition as a charge for breaking rock, excavating, or the like. Prior-art device do not show bars or rods inserted into a borehole that include rugged, simple, and forceful frictional holding means that bear against the side of a borehole and which are not activated by an exploding charge.

The disadvantages of the prior art are as follows:

1. Many prior-art devices require that the borehole be filed with a liquid, such as water, to transmit the shock and energy to the rock. The requirement to have the hole full of water makes the method difficult or impossible to use in upslanted holes, leaky holes, etc.
2. The devices do not have a method of locking the tool in the hole before the device is fired. Sloevsky and others have a momentary lock that is powered by the pressure at the instant of detonation but does not operate before or after the pulse. This also makes it impossible to use in up holes or upslanting holes where the tool can fall out by gravity.
3. The location of the cartridge in a chamber outside of the hole and the need to transmit the pressure pulse through the tool causes great stress to the mechanical parts and can eventually lead to failure. This design does not allow the explosive force to be concentrated at the bottom of the hole which diminishes its breaking power.
4. Prior-art devices do not allow a projectile to be fired in the hole to generate fractures and so enhance the breaking power of the tool at the same time that the pressure of sealed explosive gases is used.

SUMMARY OF THE INVENTION

The present invention overcomes all of the disadvantages of the prior art. It eliminates the need of a fluid filled hole, works in any orientation, concentrates the force at the bottom of the hole, does not stress the breaker components, and provides a means to fire a projectile into the hole to generate fractures.

The present invention uses solid propellent/explosives to fragment rock and other hard materials in a more controlled and safer manner than is possible with conventional explosives. The breaker provides a means to introduce a self contained solid propellent/explosive cartridge (such as a shotgun shell) into a borehole, lock and seal the charge in place, and then activate the propellent/explosive from a remote location in a safe and reliable manner. When the propellent/explosive is detonated, the borehole is rapidly pressurized with gas which creates high internal stress. The stress overcomes the tensile strength of the material to form fractures and then propagates the newly created and existing fractures to the nearest free surface. Thus, brittle materials with low tensile strength such as rock, concrete, or minerals are easily broken from the inside out with a minimum of energy.

The operation just described is the gas pressurization mode of operation. The cartridge breaker however, has a second mode of operation which combines both gas pressurization and projectile impact. In the projectile impact mode, the breaker fires a slug loaded cartridge instead of a blank cartridge. The slug or projectile impacts the bottom of the hole causing fractures to form at and around the bottom of the hole. These fractures are then pressurized by the propellent gas to break the material. The projectile firing mode of operation is especially useful in hard, dense material. The projectile can be steel, lead, ceramic, etc. and can be made in various sizes and shapes.

The primary fields of application for the cartridge breaker are for mining and construction. The present invention can be used in all materials such as rock, concrete and minerals. As a primary fragmentation system, it will be used to mine minerals, and to excavate openings such as tunnels, shafts, trenches, etc. As a secondary fragmentation system, it will be used to break oversize materials such as boulders, trim mine openings and excavations, and demolish structures such as foundations, buildings and bridges, etc.

DETAILED DESCRIPTION OF THE PREFERRED EMBODIMENT

Here, and in the following claims, "cartridge" means a packaged explosive charge and primer, and "primer" means a firing means for the explosive charge of the cartridge which is activated by striking the primer, applying electric voltage, or the like.

Figures 1, 2, 4, 5:
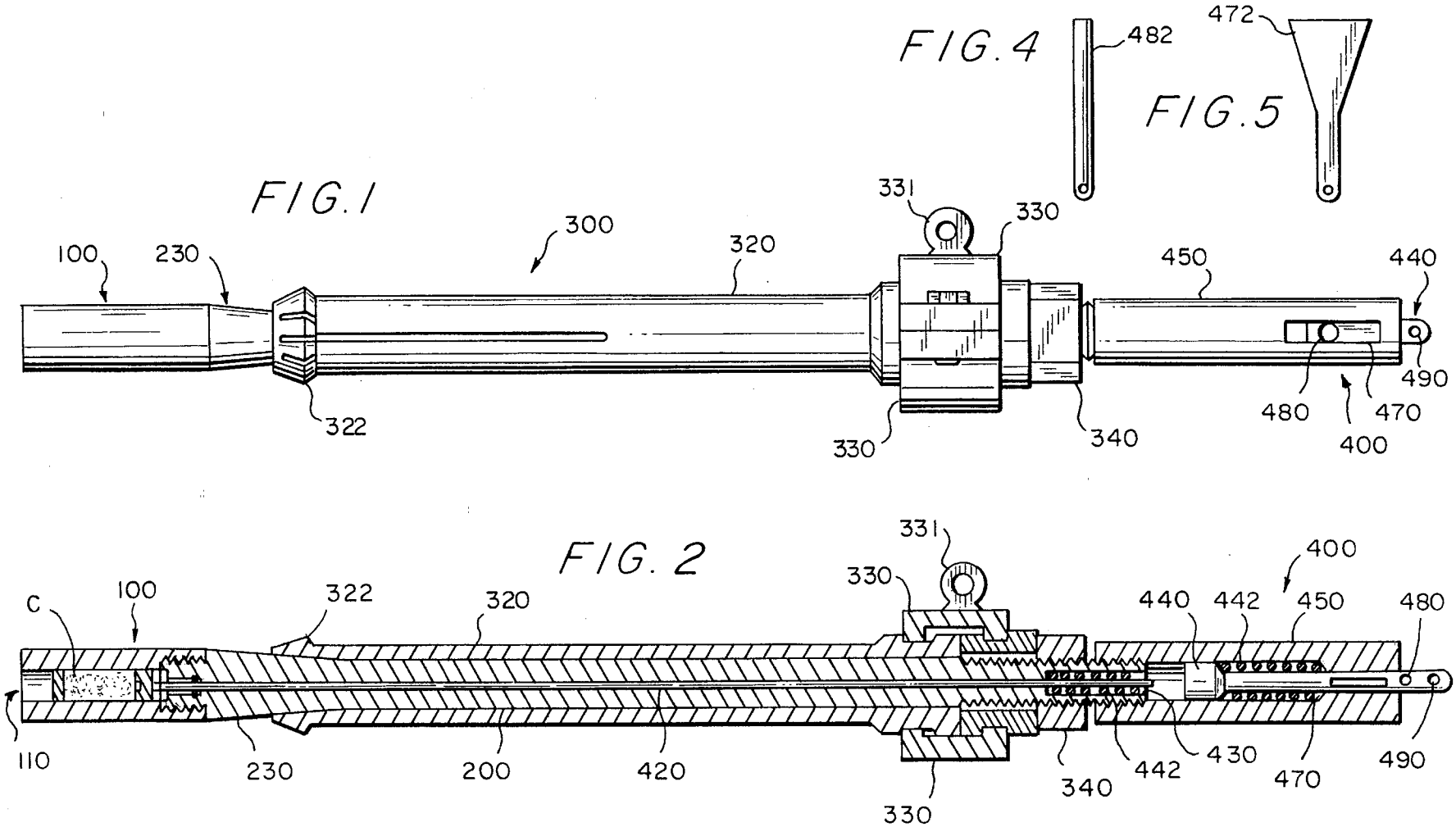
FIG. 1 is a side view of the invention.
FIG. 2 is a cross-sectional side view of the invention taken across a central axis of the invention.
FIG. 4 is view of a drawpin.
FIG. 5 is view of a drawbar.

The main subsystems of the cartridge breaker are shown in FIGS. 1 and 2. These are the gun 100, rod 200 and locking mechanism 300, and trigger device or firing mechanism 400.

The gun holds a loaded cartridge C which most commonly is a shotgun shell. The cartridge firing chamber 120 has an opening to accept the cartridge C and gas-release openings 110 (best shown in FIGS. 3A–3C) at one end or side to allow the high pressure propellent gas and optionally the slug to enter the borehole. The gun 100 is threaded on the other end to secure it to the rod 200, which is the main body of the breaker.

Figure 3A:
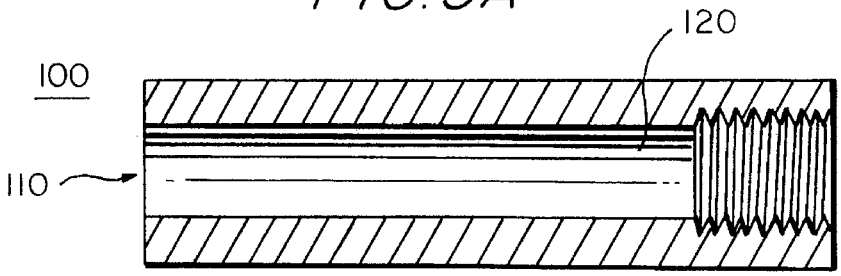
FIGS. 3A, 3B, and 3C are cross-sectional side views of various embodiments of the gun.
Figure 3B:
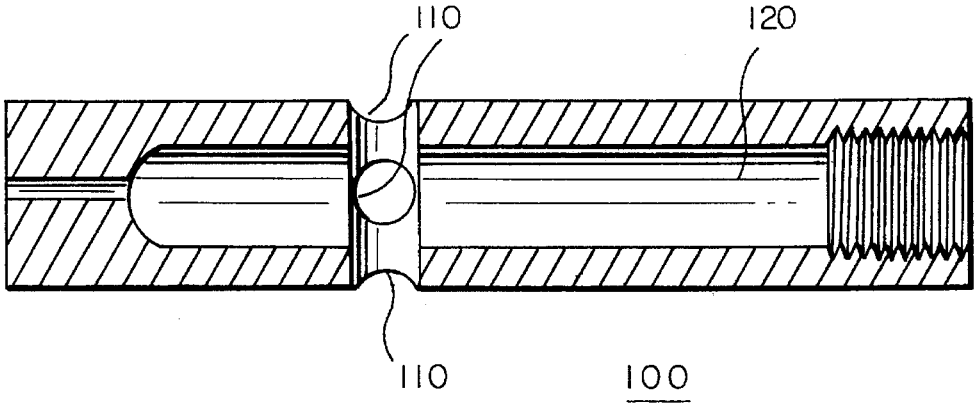
Figure 3C:
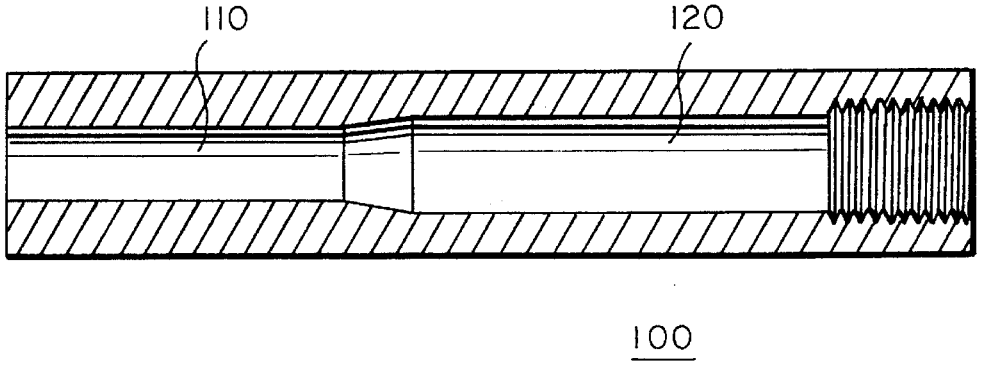

The gun 100 can be of several different lengths and diameters and with openings 110 at the end or sides depending on whether the gas pressure mode or slug firing mode is used. FIGS. 3A, 3B, and 3C shows the types of guns 100 that can be used. The gun and firing chamber 120 can vary in size to fit the cartridge used but, the normal size would be from 8 gauge to 12 gauge. The gun 100 is fabricated of high strength tool steel and is heat treated to increase its strength and toughness.

The cartridge itself can be loaded either as a blank for gas pressurization only or with a slug projectile for a combined slug and gas operation. The cartridge C is normally a self-contained commercial shotgun shell that consists of the outer casing, the primer, the propellants/explosive, wadding, and optionally the slug or projectile. Modern shotgun cartridges are loaded with smokeless powder which is classified either as a propellent or low explosive. The amount of propellent loaded in the cartridge can be varied to allow the energy to be matched to the breaking job. The use of a self-contained cartridge C makes the breaker simple to use and gives it a high degree of safety and reliability. Note that the cartridge C is not part of the present invention.

The locking and sealing subsystem 300 consists of the internal rod 200 with wedge or taper end 230, outer split tube 320 with locking ring 322, split ring connector bushing 330, and locking nut 340. The rod 200 with taper end 230 and split tube 320 are fabricated of high strength tool steel and heat treated for strength and toughness. The rod 200 and split tube 320 are connected with the split ring connector bushing 330. This arrangement allows the taper 230 to be pulled back into the split tube 320 when the locking nut 340 is screwed against the end of the connector bushing 330. The locking nut rides on the threaded end of the rod 200.

The rod 200 is threaded on both ends and internally bored to house the firing pin 420 and firing pin return springs 422. The rod 200 has a small taper 230 machined at one end with an angle that can vary but normally ranges from 5 to 6 degrees. This taper portion 230 extends for a short distance along its length, which has a circular cross-section. The length and diameter of the rod 200 can also vary but normal lengths would be 30 to 40 inches and normal diameters 1 to 3 inches.

The outer split tube 320 fits over the inner taper portion 230 and is held in position by the split ring connector bushing 330. The split tube 320 is split longitudinally from the cartridge end for approximately ⅓ its length by two or more slots. This, along with careful heat treatment, allows the end of the tube to expand without breaking. The split tube fits over the rod 200 and has a wall thickness of approximately ¼ inch.

A projection which is preferably a locking and sealing ring 322 is built around the circumference of the split tube 320. The circular locking ring 322 contacts the walls of the borehole to lock the breaker in place. The locking ring 322 also provides a second important function which is the sealing of the borehole to contain the high pressure propellent gas. This sealing function is critical to the success of this tool. The ring 322 can be made in a variety of cross-sectional shapes including flat, round and pointed.

The taper 230 and split tube 320 are constructed so that when the breaker is installed in the borehole the rod 200 can move a small amount relative to the split tube 320, which is against the sides of the borehole by the ring 322. Thus, if the rod 200 is driven back out of the hole by the pressure of the propellent gas, it will push into and further expand the fixed outer tube 320 against the walls of the hole. This will increase the anchoring force and prevent the breaker from being blown out of the hole.

The firing system 400 consists of the firing pin 420 and return spring 422, both housed inside the rod 200. The firing hammer 440 and firing spring 442 are housed in a separate external housing 450 with the rest of the trigger device.

The firing pin 420 extends the length of the rod 200 and is housed in a passage in the center of the rod 200. It is held in position longitudinally by locking rings 430 at each end and by the return spring. This arrangement keeps the firing pin 420 from extending beyond the end of the rod 200 and contacting the cartridge C until the unit is ready to be fired.

The firing hammer 440 and firing spring 442 are located in an outside housing or body 450, which is threaded onto the end of the rod 200. The firing hammer 440 is pulled back by the operator to compress the firing spring 442 and cock the hammer. The external end of the hammer 440 has a hole 490 to facilitate cocking. The firing hammer, when released, is propelled forward by the firing spring 442 to strike the end of the firing pin 420 with sufficient momentum to overcome the firing pin return spring 422. The firing pin 420 is then pushed out of the rod 200 sufficiently to strike the cartridge primer and hence detonate the cartridge C. This arrangement makes accidental firing of the breaker tool difficult and is an extra safety feature of this tool.

Two trigger devices for the breaker can be used; the one-step and the two-step. Both methods allow the operator to fire the tool from a safe position.

The one-step type uses a wedge shaped drawbar 472, shown in FIG. 5, that is pulled through slots 470. The slots 470 are similar in shape; one is in the firing hammer 440 and one is in the firing housing 450. The wedge-shaped drawbar 472 is manually pulled by the operator using a long cord tied to the drawbar 472. This pulling by the operator automatically pulls back the hammer 440 to compress the firing spring 442 as the wedge is pulled through the slots 470; then, when the drawbar 472 is pulled entirely through the slot 470 in the hammer 440, the hammer is released.

In the two-step process the firing hammer is pulled by the operator using a handle inserted into the hole 490 in the end of the hammer. When fully drawn back, a trigger drawpin 482, shown in FIG. 4, is inserted through a hole 480 in the hammer 440 to hold it in the cocked position. To fire the tool the safety drawpin 482 is pulled out using a long cord.

In an alternative embodiment, the hammer 440 and the firing pin 420 may be combined into a single member while retaining the trigger devices described above. In such an embodiment the firing pin and hammer would be simultaneously drawn back and then released to accelerate together against the primer of the cartridge C.

The general operation of the tool is simple and can be done by any person of normal skill. First a borehole is drilled into the material to be broken using a standard drill, which is not part of the present invention. The normal size borehole will be between 1-¾ and 3 inches and the length of the hole will normally be 1 to 3 feet, but both diameter and length can vary outside of these norms. The breaker tool can be used in a range of hole diameters by simply changing the outer diameter of the split tube 320. The normal expansion of the tube 320 will allow a single tube to be used in holes with approximately a ¼ inch range of diameters.

Once the hole is drilled, the loaded cartridge C is inserted into the firing chamber 120 of the gun 100 and the gun is threaded onto the internal end of the rod 200. The breaker tool is inserted into the borehole, leaving a few inches between the end of the tool and the bottom of the hole to provide a place for the propellent gas to expand. The tool is then locked in place by turning the locking nut 340 with a wrench until the breaker is secure. This action pulls back the rod 200 and expands the outer tube locking ring 322 against the borehole walls.

The breaker is now fired by the operator from a safe location using a long cord attached to the trigger mechanism, using either the one-step (wedge-shaped drawbar) process or the two-step (drawpin) process. The long firing cord allows the operator to be in a safe position out of danger of flyrock. The breaker also has another safety feature, anchor cord (not shown). The anchor cord is first fixed to the anchor cord mount 331 and then attached to a heavy weight or fixed object. This prevents the tool from becoming a flying projectile if blown out of the hole.

The cartridge C used with the breaker is normally a standard shotgun shell but can be specially constructed if necessary. The cartridge consists of the outer casing, primer, propellent/explosive, wadding and in some cases a slug or bullet projectile. The cartridge can be a variety of sizes but normally will be 8 to 12 gauge. It can use standard, magnum, or partial propellent charge.

The breaker can be used singly or in multiples depending on the size of the breaking job. On large jobs, the tool can be mounted on a machine or combined with a drill to provide a drill/breaker unit. These mountings are not part of the present invention.

The present invention has numerous advantages over the prior art:

1. It does not require liquid in borehole to operate, which allows the tool to be used in upslanted holes and leaky holes and eliminates the need for a liquid supply;
2. The mechanical locking and pressure sealing mechanism locks the tool in boreholes of any orientation, prevents the tool from blowing out of the hole, and also provides a simple, effective seal to contain the propellent gas;
3. The invention has the capability of shooting projectiles into the bottom of the hole. This initiates fractures to help break hard, dense materials in conjunction with the high pressure of trapped gasses, which spread cracks;
4. The bottomhole location of the gun concentrates the pressure pulse at the most effective position to break the rock and eliminates damaging stress to the mechanical components;
5. The remote, one-step cocking and firing mechanism eliminates the need to cock the firing spring while standing near the loaded breaker.
6. The use of ordinary firearm ammunition for the explosive charge reduces the cost, because ammunition is a standard item made in huge quantities, and need not be specially ordered or delivered. The use of ammunition allows explosive charges to be purchased easily almost anywhere without the need for licenses or permission of authorities.

The present invention is not limited to the particular embodiment described above, but includes all within the scope of the following claims.

What is claimed is:

1. A breaker for use with an explosive cartridge, the breaker insertable into a borehole in material, the breaker comprising:

an elongate rod having an internal end and an external end;

a gun adapted for holding the cartridge, the gun mounted at the internal end;

a trigger device coupled to the external end; and firing means disposed along a length of the rod to connect the trigger device to the cartridge for firing the cartridge;

whereby, when the breaker is inserted into the borehole with the gun disposed within the borehole, the cartridge may be fired with the trigger device from without the borehole; such that material surrounding the borehole may be broken by explosive force.

2. The breaker according to claim 1, further comprising locking means for holding the breaker firmly within the borehole, the locking means including an expanding piece disposable within the borehole, the expanding piece forcibly movable outwardly against an inside surface of the borehole to hold the breaker therewithin.

3. The breaker according to claim 2, wherein the locking means further includes an outer projection on the expanding piece, such that the projection frictionally grips the inside surface of the borehole when the expanding piece is moved outwardly.

4. The breaker according to claim 2, wherein the rod is cylindrical and the locking means further comprises:

a generally conical taper proximal the internal end of the rod;

a sleeve tube slidably surrounding the rod, the sleeve tube having a resiliently expandable inner end proximal the taper; and longitudinal force means for sliding the inner end of the sleeve tube against the taper;

whereby the inner end is expanded against an inside surface of the borehole to seal pressure within the borehole.

5. The breaker according to claim 4, wherein the locking means further includes an outer projection disposed proximal the inner end of the sleeve tube, such that the projection frictionally grips the inside surface of the borehole when the inner end is expanded.

6. The breaker according to claim 4, wherein the inner end of the sleeve tube includes longitudinal slots to allow resilient expansion.

7. The breaker according to claim 4, wherein the longitudinal force means includes a threaded portion at the external end of the rod and a nut engaging the threaded portion, the nut bearing against an outer end of the sleeve tube, whereby the nut may be rotated to force the sleeve tube against the taper and expand the inner end of the sleeve tube.

8. The breaker according to claim 7, wherein the longitudinal force means further comprises a split ring bushing for coupling the outer end of the sleeve tube to a collar adjacent the nut.

9. The breaker according to claim 2, wherein the locking means further comprises anchor cord means for tying the breaker to a heavy object.

10. The breaker according to claim 1, wherein the gun includes a firing chamber adapted to hold the cartridge therein and at least one opening between the firing chamber and the borehole for explosion force to exit the firing chamber.

11. The breaker according to claim 10, wherein the opening is axially disposed relative to the cartridge such that a projectile expelled from the cartridge may strike the material at a bottom of the borehole.

12. The breaker according to claim 10, wherein the opening is radially disposed relative to the cartridge, such that explosion gas expelled from the cartridge may impinge upon the material at a side of the borehole.

13. The breaker according to claim 12, wherein the firing chamber is closed at the end distal the rod.

14. The breaker according to claim 10, wherein:

the cartridge includes a primer;

the rod includes an internal passage; and the firing means further comprises a firing pin extending through the internal passage from the trigger device to the firing chamber, such that the firing pin may longitudinally move against the primer to fire the cartridge.

15. The breaker according to claim 14, wherein the trigger device further comprises a trigger device body, a hammer slidable within the body for hitting the firing pin, a spring disposed between the hammer and the body for urging the hammer from a cocked position of the hammer towards the firing pin, and a mechanism for releasing the hammer from the cocked position, such that the hammer may hit the firing pin when released.

16. The breaker according to claim 15, wherein the mechanism includes a hammer, the hammer having a longitudinal extension, the extension including a transverse aperture for accepting therethrough a drawpin, the transverse aperture adjacent a surface of the body when the hammer is in the cocked position, whereby the drawpin may be pulled from the transverse aperture to release the hammer from the cocked position and fire the cartridge.

17. The breaker according to claim 15, wherein the mechanism includes a hammer, the hammer having a longitudinal extension, the extension including a first slot for accepting therethrough a drawbar, the body including a second slot for accepting therethrough a drawbar, the first slot and the second slot aligned when the hammer is in a cocked position; the first slot and the second slot defining therebetween a longitudinal open distance for accepting the drawbar, the distance longer in the cocked position; the drawbar having inclined sides, such that the drawbar may be pulled through the slot to increase the distance;

whereby when the drawbar is pulled entirely through the slot the hammer is released from the cocked position and fires the cartridge.

18. The breaker according to claim 10, wherein the cartridge is a firearm ammunition cartridge and the firing chamber is dimensioned to hold the firearm ammunition cartridge therewithin.

19. The breaker according to claim 18, wherein the cartridge is a shotgun cartridge.

20. The breaker according to claim 18, wherein the cartridge includes a circumferential rim and the gun is mounted to the internal end of the rod by mating screw threads, such that the rim is disposed between the rod and the gun when the gun is screwed onto the rod.

* * * * *